US011462374B2

(12) United States Patent
Kale et al.

(10) Patent No.: US 11,462,374 B2
(45) Date of Patent: Oct. 4, 2022

(54) KINEMATIC LINKAGE ARRANGEMENT FOR A SWITCHING DEVICE

(71) Applicants: Abhishek Kale, Maharashtra (IN); Thomas Knabe, Berlin (DE)

(72) Inventors: Abhishek Kale, Maharashtra (IN); Thomas Knabe, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 17/308,026

(22) Filed: May 4, 2021

(65) Prior Publication Data

US 2021/0350988 A1 Nov. 11, 2021

(30) Foreign Application Priority Data

May 5, 2020 (IN) ..... 202031019064

(51) Int. Cl.
*H01H 3/36* (2006.01)
*H01H 33/42* (2006.01)
*H01H 33/12* (2006.01)

(52) U.S. Cl.
CPC ..... *H01H 33/12* (2013.01); *H01H 3/36* (2013.01)

(58) Field of Classification Search
CPC ..... H01H 33/42; H01H 33/40; H01H 33/666; H01H 2033/6667; H01H 3/36; H01H 3/30; H01H 3/3015; H01H 3/42; H01H 3/46
USPC ..... 200/48 R, 50.38, 50.39, 416; 218/120, 218/140, 153, 154
See application file for complete search history.

(56) References Cited

U.S. PATENT DOCUMENTS 3,597,556 A * 8/1971 Sharp ..... H01H 3/46 218/4
4,016,385 A * 4/1977 Golioto ..... H01H 3/42 200/18
4,550,234 A * 10/1985 Steinemer ..... H01H 33/666 218/4
4,973,803 A * 11/1990 Fujiwara ..... H01H 33/666 218/120
7,724,489 B2 * 5/2010 Montich ..... H01H 31/003 361/115
9,666,392 B2 * 5/2017 Gruenler ..... H01H 17/26
2005/0150869 A1 * 7/2005 Vaghini ..... H01H 33/125 218/118
2013/0284704 A1 * 10/2013 Gentsch ..... H01H 33/666 218/140

* cited by examiner

*Primary Examiner* — William A Bolton
(74) *Attorney, Agent, or Firm* — Lempia Summerfield Katz LLC

(57) ABSTRACT

A switching device having a pole assembly, a drive unit, and a kinematic linkage arrangement is provided. The pole assembly includes interrupter units operably connected via an interlink arrangement representing a circuit breaker and a grounding switch, respectively. The drive unit operates the interrupter units. The kinematic linkage arrangement includes at least a lever member operably connected to the interlink arrangement and the drive unit, a cam member rigidly connected to the drive unit, and an elastic member adjustably connected to the cam member. The kinematic linkage arrangement transfer a predefined torque to the drive unit to maintain the circuit breaker in an open state.

11 Claims, 8 Drawing Sheets

(PRIOR ART)

(PRIOR ART)

KINEMATIC LINKAGE ARRANGEMENT FOR A SWITCHING DEVICE

This application claims the benefit of Indian Patent Application No. IN 202031019064, filed on May 5, 2020, which is hereby incorporated by reference in its entirety.

BACKGROUND

The present disclosure relates to switching devices such as circuit breakers. More particularly, the present disclosure relates to a drive arrangement of a circuit breaker.

Like Circuit breakers, grounding or earthing transformers are an important component of any power network. More particularly, grounding transformers are provided for renewable power generator plants, for example, in large multi-turbine wind farms where the substation transformer frequently provides a sole earthing source for distribution system. A grounding transformer placed on a wind turbine string provides a ground path in an event when the string becomes isolated from the system ground provided by the substation transformer. A ground fault on a collector cable causes the substation circuit breaker to open, and the wind turbine string becomes isolated from the system ground source. The wind turbines do not always detect this fault or the fact that the string is isolated and ungrounded. As a result, the generators continue to energize the collector cable, and the voltages between the un-faulted cables and the ground rise far above the normal voltage magnitude. This results in a staggering increase in operational costs.

FIG. 1A illustrates a wind power generation system 100 according to the state of the art. The wind power generation system 100 has a string of wind turbines WTG1-WTGX each of which are connected to a medium voltage circuit breaker 101 and a grounding transformer 102, via respective line transformers 103A-103X. This wind power generation system 100 is then connected to a step-up transformer 104 to step up the voltage suitable for power transmission over the transmission system 105. FIG. 1B illustrates a wind power generation system 100 including a switching device 106 having a combined functionality of circuit breaking and grounding switch according to the state of the art. FIG. 1B discloses an embodiment of the wind power generation system 100 shown in FIG. 1A. In this embodiment, the circuit breaker 101 and the grounding transformer 102 are integrated into a single switching device 106 and are operably connected to one another. The switching device 106 performs the switching and grounding through a combined medium voltage circuit breaker and a grounding vacuum switch, thereby eliminating the grounding transformer 102. However, for performing defined functions of the circuit breaker and the grounding switch, the grounding switch is to operate with a time delay after operation of the circuit breaker. For example, during opening of the circuit breaker after separation of contacts of the circuit breaker, at least a few milliseconds are to pass before the grounding switch contacts close (e.g., the switching device 106 is earthed). This allows for additional voltage present if any voltage across the contacts of the circuit breaker is to be discharged before the grounding takes place, thereby providing completion of arc quenching.

SUMMARY AND DESCRIPTION

The scope of the present invention is defined solely by the appended claims and is not affected to any degree by the statements within this summary.

The present embodiments may obviate one or more of the drawbacks or limitations in the related art. For example, a switching device that addresses the aforementioned problem of maintaining a time delay during operation of interrupter units while providing ease of assembly and mechanical design without increase in costs associated therewith is provided.

The switching device disclosed herein is, for example, a medium voltage switchgear having an operational rating of up to 38 kilo Volts and up to 40 kilo Amperes and includes at least one pole assembly in an operable connection with a drive unit, as disclosed above. For a three-phase switchgear, there are three pole assemblies one per electrical phase connected to the drive unit.

According to an embodiment of the present disclosure, the switching device is employed in renewable power generation stations, such as a wind power generation station and is a three phase switching device having one pole assembly per phase. The pole assembly includes post insulators supporting two vacuum interrupters connected to one another via the interlink arrangement. Each of the interrupters represents a circuit breaker and a grounding switch, respectively. The interlink arrangement is operably connected to a moveable member of the first interrupter unit and a moveable member of the second interrupter unit of the pole assembly. The interlink arrangement sets a stroke of the second vacuum interrupter (e.g., the grounding switch) without affecting a stroke of the first vacuum interrupter (e.g., the circuit breaker).

The switching device disclosed herein includes a kinematic linkage arrangement addressing the aforementioned object, including a lever member, an elastic member, and a cam member. The lever member is operably connected to the interlink arrangement of the pole assembly and to a drive unit shaft of the drive unit via an elongate member of the drive unit. The drive unit shaft is a common shaft across the pole assemblies operating interrupter units therein. The elongate member is connection rod between the drive unit shaft and the interlink arrangement via the lever member. In one embodiment, the lever member is present per pole assembly connected to the drive unit shaft via respective elongate members. However, the cam member and elastic member are common across all pole assemblies. The lever member is configured to pivot about a point (e.g., a fixed point) for enabling movement of the first interrupter unit and the second interrupter unit of the pole assembly between respective closed states and the open states. In one embodiment, the lever member is configured of a shape that has three connection points: a first point being, for example, a pivot point; a second point allowing rigid connection to the interlink arrangement and to the moveable contact arms of the interrupter units, thereby enabling movement of the moveable contact arms; and a third point allowing rigid connection to the elongate member of the drive unit. Thus, according to an embodiment of the present disclosure, the lever member is a generally triangular shaped member offering three points of connection. In one embodiment, the lever member at the second point of connection is connected to the interlink arrangement, for example, via a pin, a screw, a nut-bolt, etc., positioned in a groove formed on an enclosure of the interlink arrangement, such that upon pivoting at the first pivotable point, the second point moves linearly along this groove. This movement causes movement of the moveable contact arms of the interrupter units in each of the pole assemblies.

The cam member of the kinematic linkage arrangement is rigidly connected to the drive unit shaft of the drive unit. The elastic member is adjustably connected to the cam member. The elastic member includes an opening spring wound on a rod such that the rod, when connected to the cam member, may move reciprocally along an outer surface of the cam member to an extent allowed by decompression of the opening spring. Thus, an axial rotation of the drive shaft causes a reciprocal rotation of the elastic member along the cam member. The elastic member and the cam member are configured to provide a predetermined torque to the drive unit for maintaining the first interrupter unit in an open state. This predetermined torque is a function of a time delay to be maintained between movement of the first interrupter unit from the closed state to the open state and movement of the second interrupter unit from the open state to the closed state. In one embodiment, the time delay is an aggregation of time delays required to be maintained between operations of respective interrupter units per pole assembly. The time delay is, for example, about 12 milli seconds to about 16 milli seconds. The opening spring imparts a certain amount of torque to this movement of the cam, thereby transferring the torque to the rotation of the drive unit shaft. Amount of torque may be varied based on a compression force exerted by the opening spring and a radius of the cam member. The compression force is a function of the material and the physical dimensions of the opening spring. The radius is a variable representing a perpendicular distance at a given time instant from a center of the drive unit shaft to a point of connection of the cam member with the rod of the elastic member. Thus, the rotation of the drive unit shaft causes movement of the cam member and the elongate member connected thereto to an extent allowed by the elastic member, thereby pivoting the lever member to open the circuit breaker contacts and remain in this open state for aforementioned time period of about 12-16 milli seconds before closing of the contacts of the grounding switch. In one embodiment, the kinematic linkage arrangement imparts the predefined positive torque during opening of the circuit breaker and a negative equivalent torque during closing of the circuit breaker, thereby decreasing overall energy required for closing of the circuit breaker and opening of the grounding switch. The kinematic linkage arrangement disclosed herein is therefore configured to assume a first position and a second position, such that: when in the first position, the first interrupter unit is in the closed state and the second interrupter unit is in the open state; and when in the second position, the first interrupter unit is in the open state and the second interrupter unit is in the closed state. The first position is a default state of operation, and the second position is triggered during occurrence of fault and/or maintenance and service operations.

According to an embodiment of the present disclosure, the opening spring is selected so as to establish an energy balance between torques provided by the opening spring, contact springs wound on spring guides of each of the interrupter units of the pole assemblies, and a closing spring of the drive unit enabling closing of the circuit breaker and opening of the grounding switch per pole assembly. Further, other elastic components of the switching device such as bellow springs of each of the interrupter units etc. may also be considered in establishing the energy balance. A simulation of various possible physical dimensions of the opening spring is performed considering a certain degree of rotation of the drive unit shaft to select an optimal physical dimension providing an overall energy balance. The degree of rotation of the drive unit shaft is a function of the stroke of the interrupter units of the pole assemblies.

The above mentioned and other features of the invention will now be addressed with reference to the accompanying drawings of the present embodiments. The illustrated embodiments are intended to illustrate but not limit the invention.

DETAILED DESCRIPTION

Figure 1A:
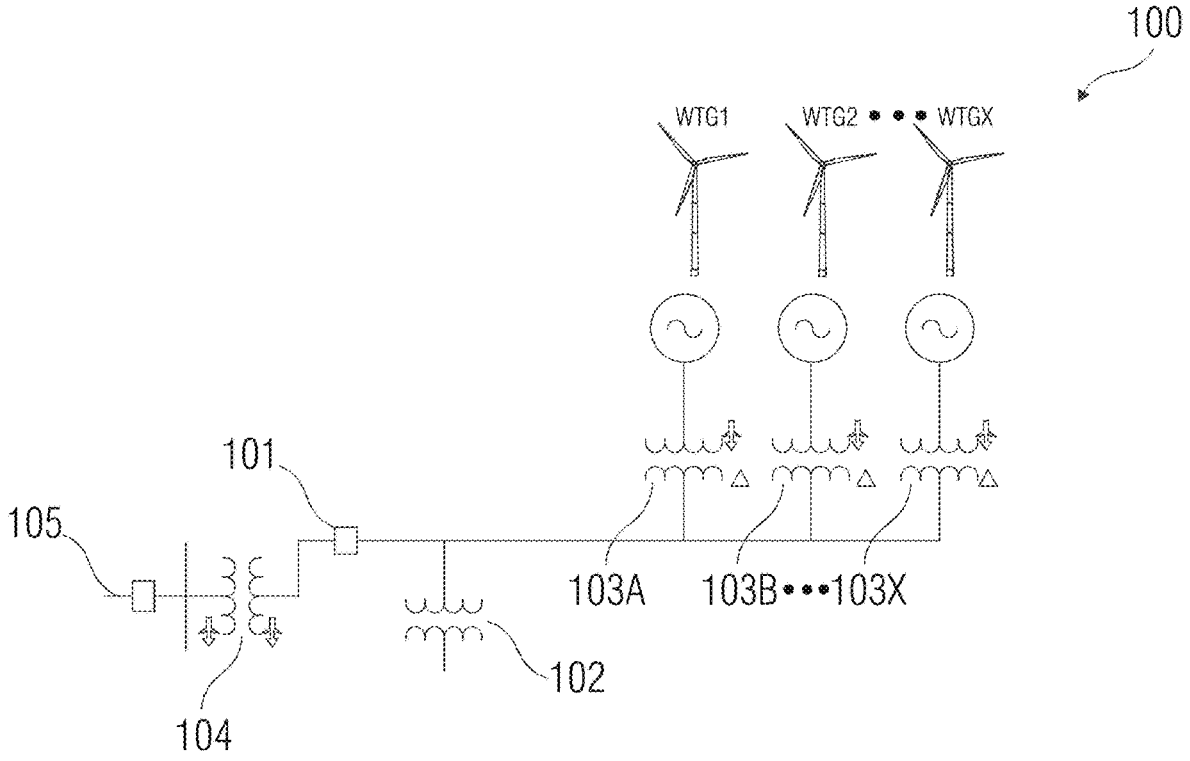
FIG. 1A illustrates a wind power generation system according to the state of the art.
Figure 1B:
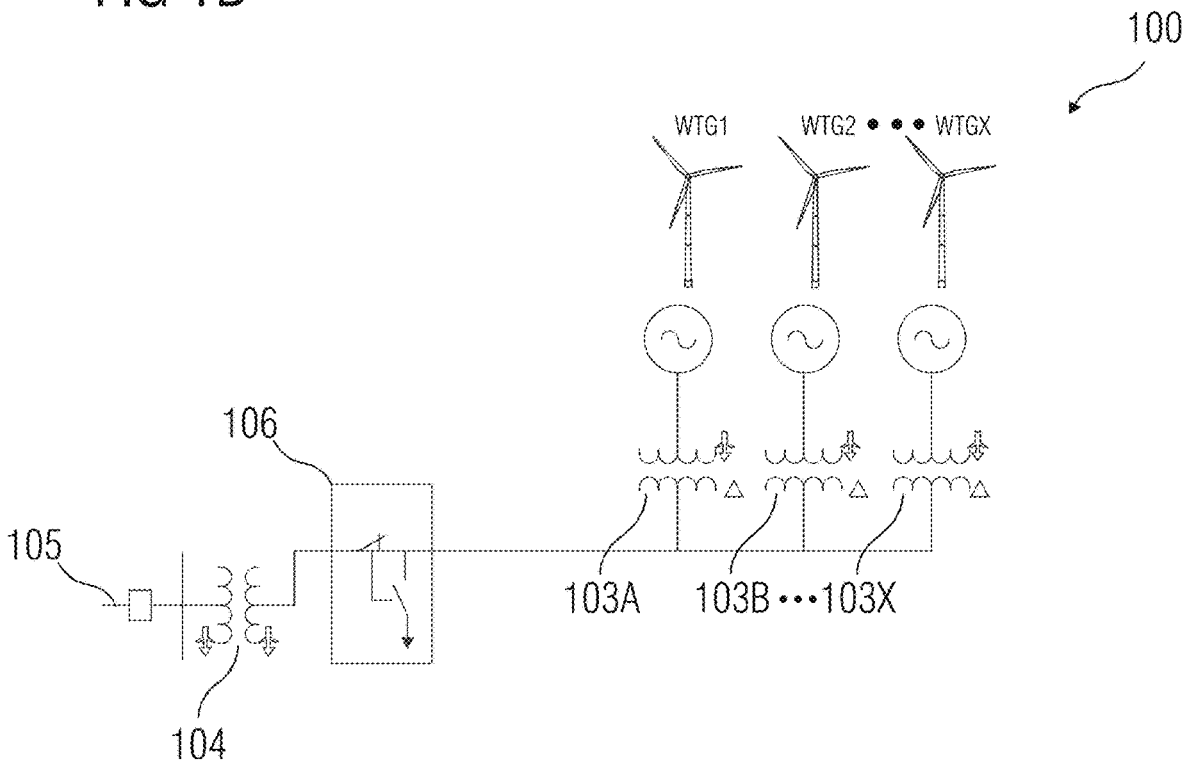
FIG. 1B illustrates a wind power generation system including a switching device having a combined functionality of circuit breaking and ground switching, according to the state of the art.

Various embodiments are described with reference to the drawings, where like reference numerals are used to refer like elements throughout. In the following description, for the purpose of explanation, numerous specific details are set forth in order to provide thorough understanding of one or more embodiments. It may be evident that such embodiments may be practiced without these specific details.

Figure 2:
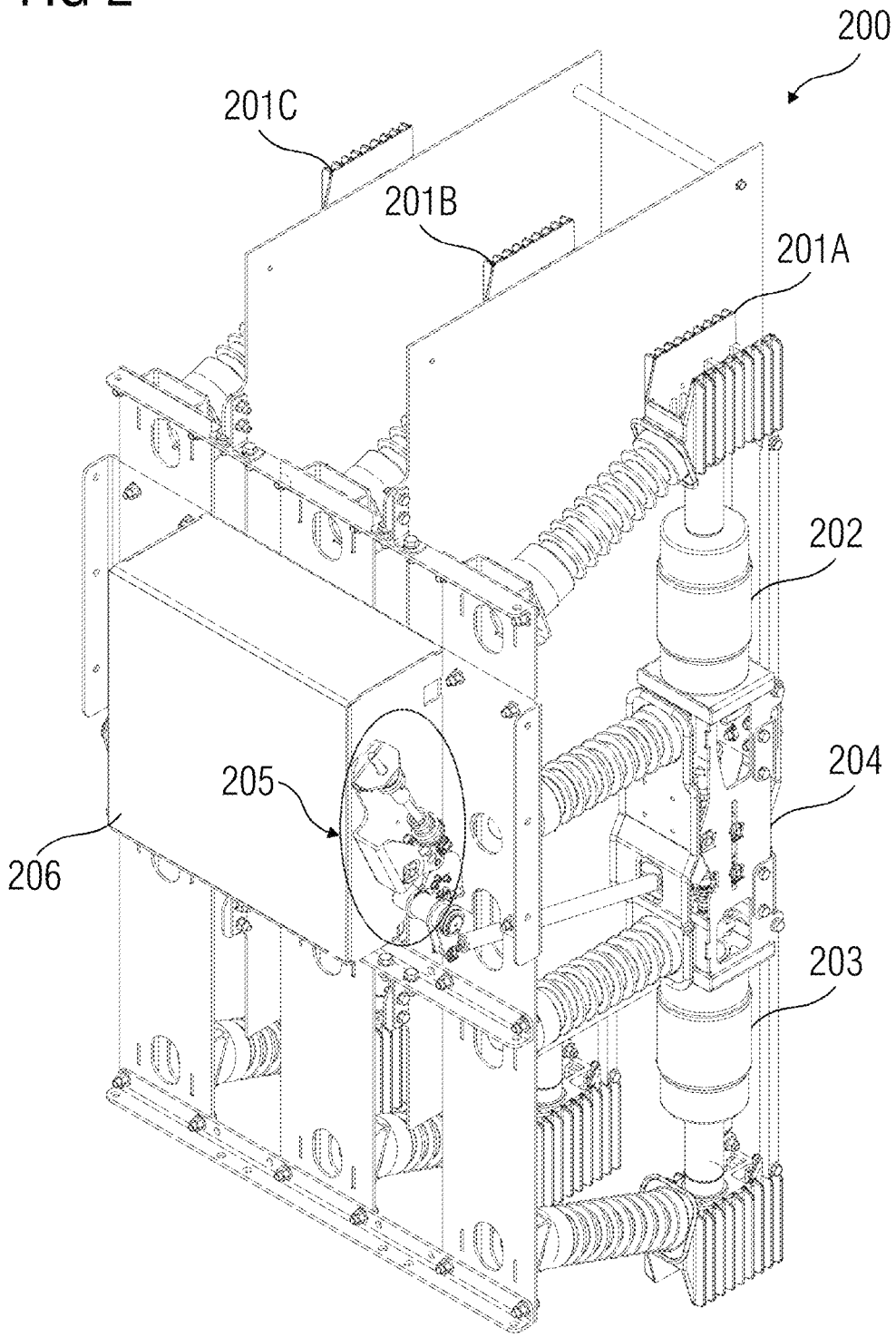
FIG. 2 illustrates a three-phase medium voltage switchgear according to an embodiment.

FIG. 2 illustrates a three-phase medium voltage switchgear 200 according to an embodiment of the present disclosure. The switchgear 200 includes pole assemblies 201A, 201B, and 201C each connected to an electrical phase. The pole assemblies 201A-201C are connected to a common drive unit 206. Each of the pole assemblies 201A-201C include a vacuum interrupter 202 operably connected to another vacuum interrupter 203 via an interlink arrangement 204. The vacuum interrupters 202 and 203 represent the circuit breaker 101 and the grounding switch 102 shown in FIG. 1A. The drive unit 206 operates these vacuum interrupters 202 and 203. The switchgear 200 thus includes an integration of the circuit breaker and the grounding switch into a single device. The interlink arrangement 204 allows for an adjustment of a stroke of the vacuum interrupter 203 (e.g., the grounding switch) without affecting the stroke of the vacuum interrupter 202 (e.g., the circuit breaker). The switchgear 200 also includes a kinematic linkage arrangement 205 physically disposed against the drive unit 206 and operably connected to the drive unit 206.

Figure 3:
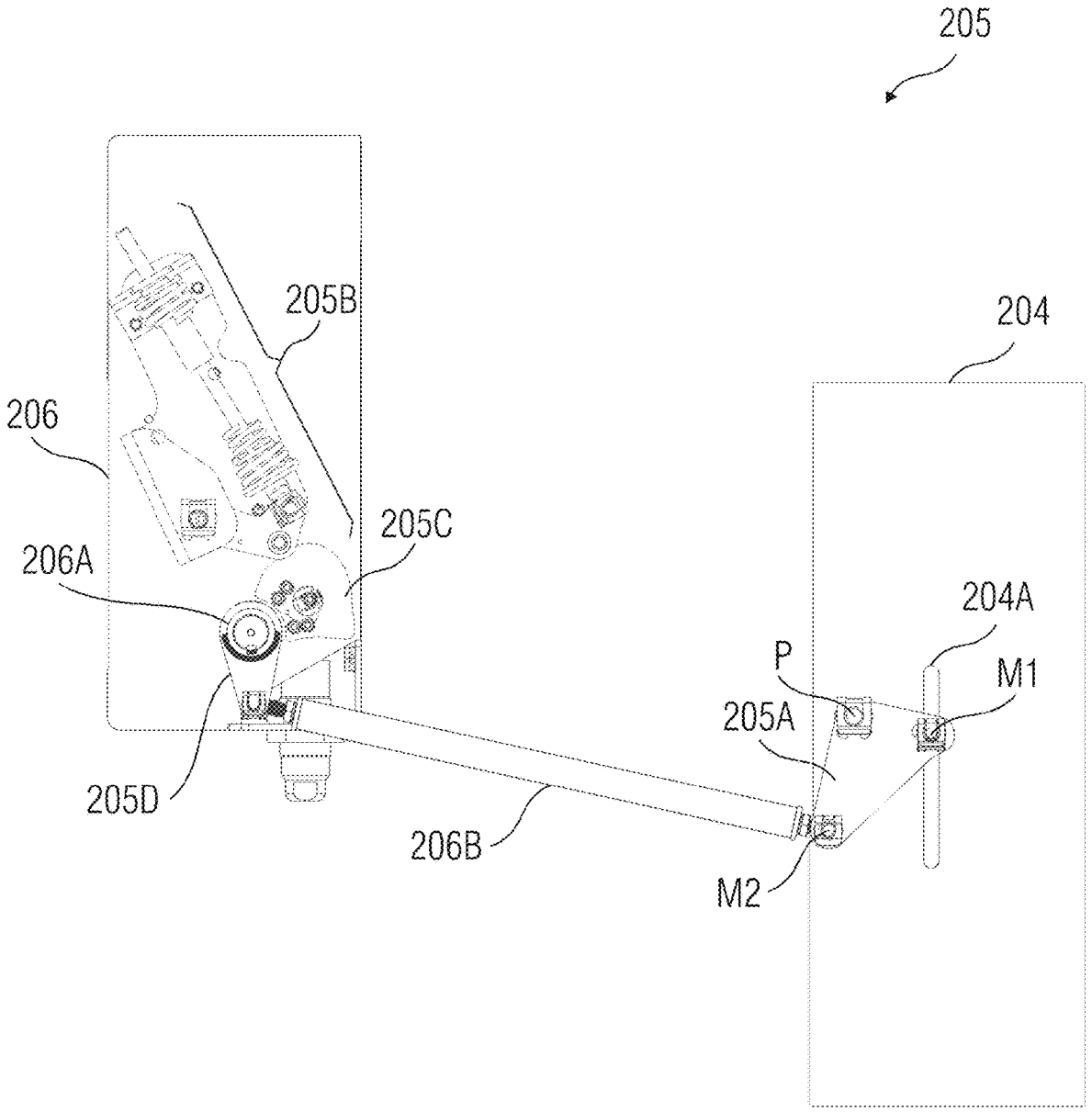
FIG. 3 illustrates a kinematic linkage arrangement of a pole assembly shown in FIG. 2, according to an embodiment.

FIG. 3 illustrates the kinematic linkage arrangement 205 of the pole assembly 201A shown in FIG. 2, according to one embodiment of the present disclosure. The kinematic linkage arrangement 205 includes a triangular shaped lever 205A operably connected to the interlink arrangement 204. The lever 205A is shaped to be pivotable about a point P when fixed to the interlink arrangement 204, allowing freedom of movement at point M1. A pivotal movement of the lever 205A about point P results in a linear movement of the lever 205A about point M1 along a groove 204A provided on an enclosure 204 housing therewithin the interlink arrangement 204. Thus, the lever 205A is in operable connection with the moveable members (not shown) of the interrupter units 202 and 203 via the groove 204A. Therefore, the linear movement of the lever member 205A results in opening and closing operations of the first interrupter unit 202 and the second interrupter unit 203.

The kinematic linkage arrangement 205 includes an elastic member 205B, a cam 205C, and a pin 205D. The pin 205D is fixedly mounted on a drive unit shaft 206A of the drive unit 206 such that rotation of the drive unit shaft 206A results in rotation of the pin 205D. The drive unit shaft 206A is operably connected to each of the pole assemblies 201A-201C, as shown in FIG. 2, via an elongate member 206B of the drive unit 206. The lever 205A is fixedly connected to the elongate member 206B at point M2. The elongate member 206B is fixedly connected to the pin 205D such that rotation of the pin 205D along with an axial rotation of the drive unit shaft 206A causes the elongate member 206B to move linearly. The cam 205C is fixedly attached to the drive unit shaft 206A such that axial rotation of the drive unit shaft 206A causes rotation of the cam 205C therewith. The elastic member 205B is adjustably attached to the cam 205C, such that with rotation of the cam 205C, the elastic member 205B glides over the cam 205C.

Figure 4A:
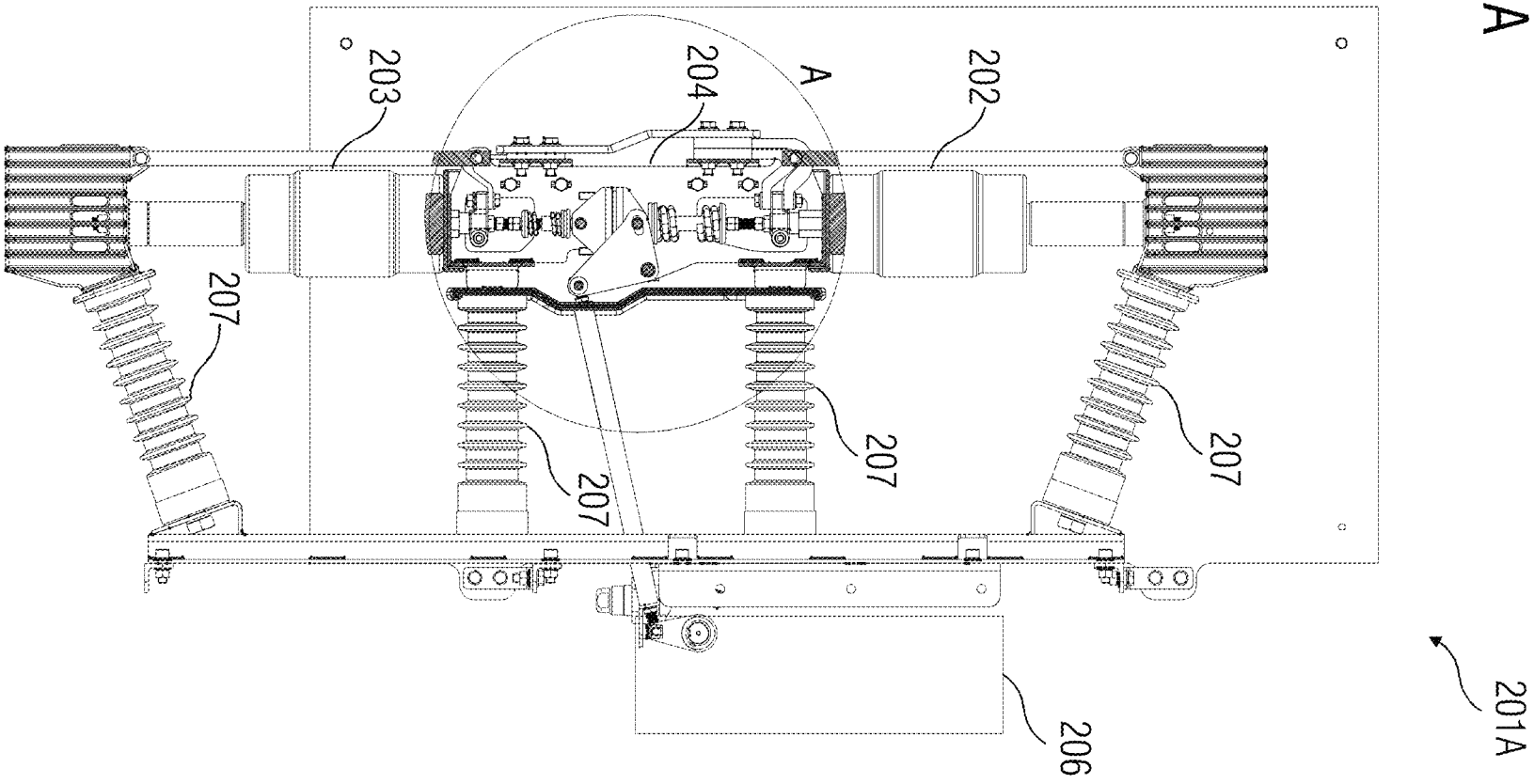
FIG. 4A illustrates the pole assembly of the switchgear shown in FIG. 2.
Figure 4B:
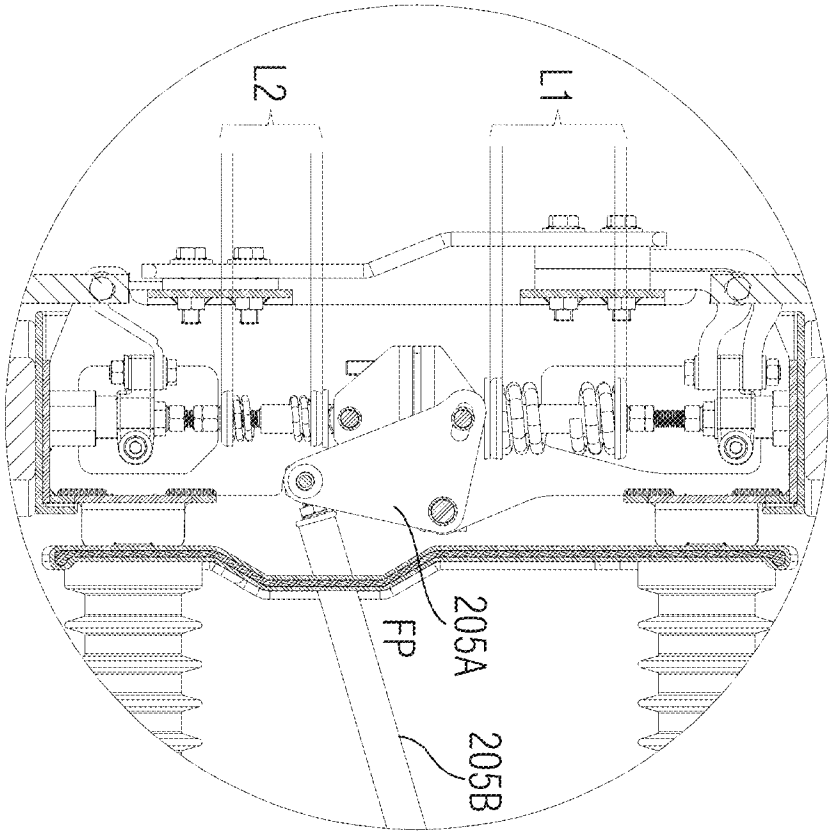
FIGS. 4B-4C illustrate enlarged views of a portion of the pole assembly, marked "A" in FIG. 4A showing various positions of the kinematic linkage arrangement shown in FIG. 3.
Figure 4C:
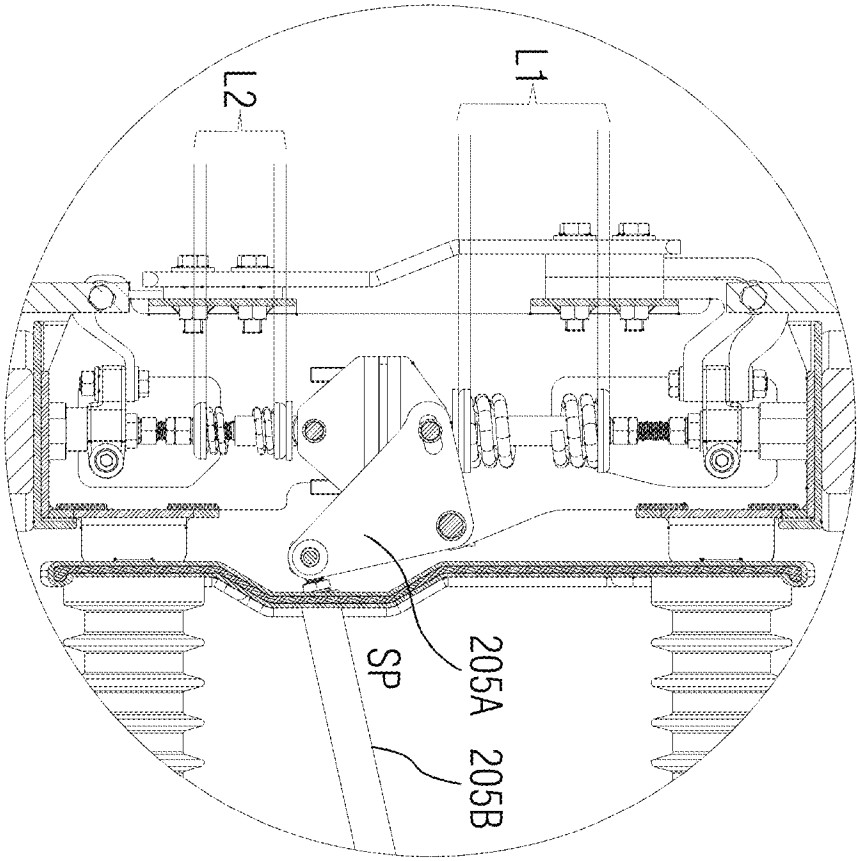

FIG. 4A illustrates the pole assembly 201A of the switchgear 200 shown in FIG. 2. The pole assembly 201A includes vacuum interrupters 202 and 203 connected via the interlink arrangement 204. The vacuum interrupters 202 and 203 are supported via post insulators 207 and are operated by the drive unit 206. FIGS. 4B and 4C illustrate an enlarged view of a portion of the pole assembly 201A, marked "A" in FIG. 4A, showing various positions of the kinematic linkage arrangement 205 shown in FIG. 3. As shown in FIG. 4B, the kinematic linkage arrangement 205 is in a first position FP. As shown in FIG. 4C, the kinematic linkage arrangement 205 is in a second position SP. In the first position FP, the lever 205A is in a default position, where the first interrupter unit 202 (e.g., the circuit breaker) is closed and the second interrupter unit 203 (e.g., the grounding switch) is open. In the second position SP, the lever 205A is pivoted by rotation of the drive unit shaft 206A, as disclosed in the detailed description of FIG. 3, to open the first interrupter unit 202 and close the second interrupter unit 203. The contact springs L1 and L2 wound on the moveable contact arms (not shown) of the interrupter units 202 and 203 respectively impart a closing force onto the contacts (not shown) of the interrupter units 202 and 203 in respective closed states. The elastic member 205B shown in FIG. 3 provides there is a time delay maintained after the first interrupter unit 202 opens and before the second interrupter unit 203 closes.

Figure 5:
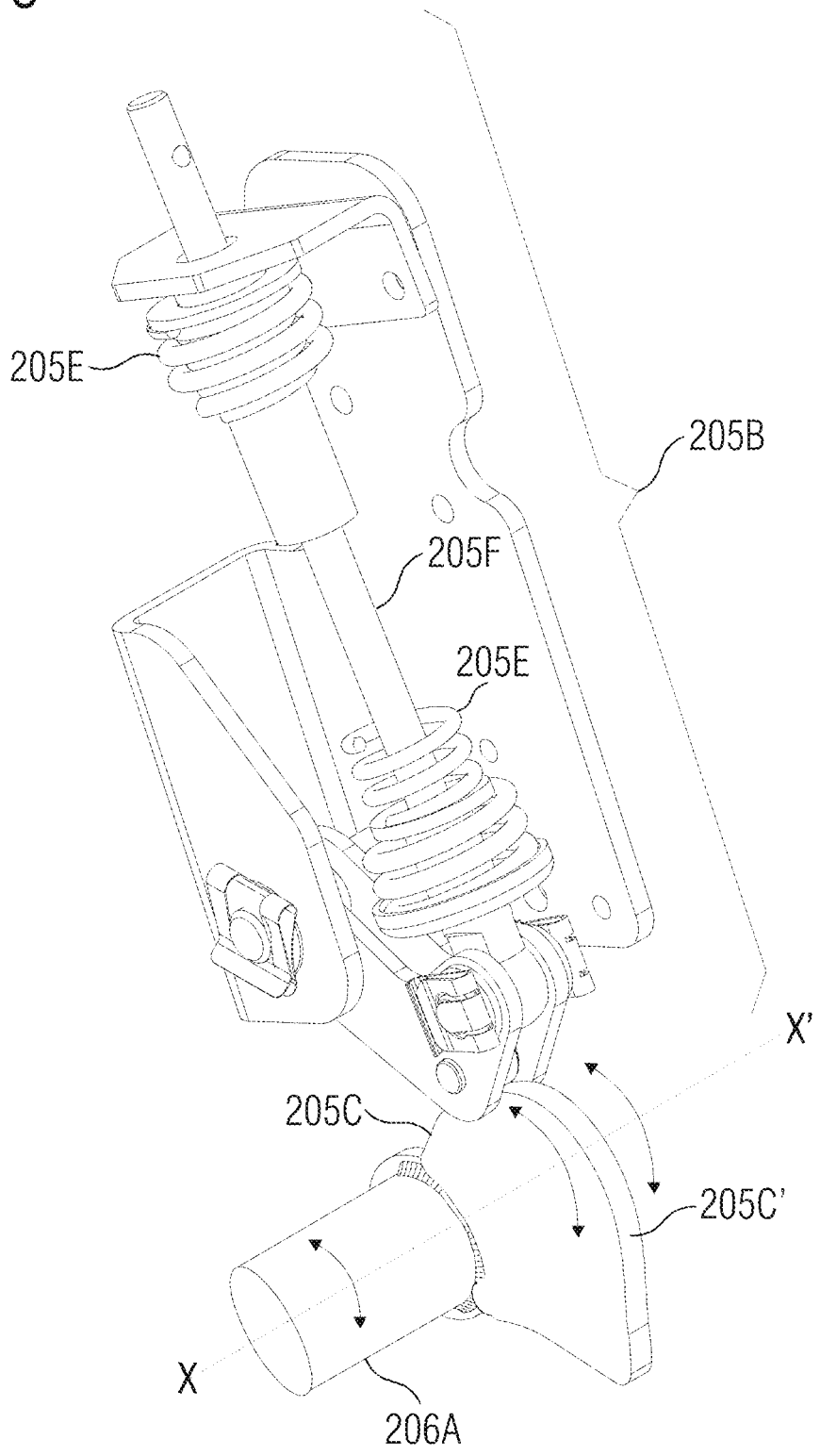
FIG. 5 illustrates an elastic member of the kinematic linkage arrangement shown in FIG. 3, according to an embodiment.

FIG. 5 illustrates the elastic member 205B of the kinematic linkage arrangement 205 shown in FIG. 3, according to an embodiment of the present disclosure. The elastic member 205B includes opening springs 205E wound on a kinematic linkage shaft 205F. The kinematic linkage shaft 205F is adjustably connected to the cam 205C, which is rigidly connected to the drive unit shaft 206A. The drive unit shaft 206A is rotatable to a predefined degree, about an axis X-X' passing therethrough. The cam 205C rotates along with the drive unit shaft 206A, causing the kinematic linkage shaft 205F to slide in the direction shown by the arrows along an outer surface 205C' of the cam 205C.

The opening springs 205E exert a torque while the drive unit shaft 206A is rotated in a clockwise direction (e.g., while opening operation of the circuit breaker, the first interrupter unit 202 shown in FIG. 2). This torque is defined based on the time delay (e.g., 12-16 milli seconds) required to be maintained before the grounding switch 203 closes post opening of the circuit breaker 202. This time delay provides complete discharge of the voltage across the contacts of the circuit breaker 202 before the switchgear 200 is grounded by closing of the grounding switch 203.

While the present invention has been described in detail with reference to certain embodiments, it should be appreciated that the present invention is not limited to these embodiments. In view of the present disclosure, many modifications and variations would present themselves to those skilled in the art without departing from the scope of the various embodiments of the present invention, as described herein. The scope of the present invention is, therefore, indicated by the following claims rather than by the foregoing description. All changes, modifications, and variations coming within the meaning and range of equivalency of the claims are to be considered within their scope.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A switching device comprising:

a pole assembly comprising:

a first interrupter unit providing a path for current flow through the first interrupter in a closed state and interrupting the current flow in an open state; and a second interrupter unit operably connected to the first interrupter unit via an interlink arrangement, wherein the second interrupter unit allows the current flow through the first interrupter unit in an open state and grounds the switching device in a closed state;

a drive unit configured to operate the first interrupter unit and the second interrupter unit of the pole assembly; and a kinematic linkage arrangement comprising at least a lever member, an elastic member, and a cam member, wherein the lever member is operably connected to the interlink arrangement of the pole assembly and to a drive unit shaft of the drive unit via an elongate member of the drive unit, wherein the cam member is rigidly connected to the drive unit shaft of the drive unit, and wherein the elastic member is adjustably connected to the cam member.

2. The switching device of claim 1, wherein an axial rotation of the drive shaft causes a reciprocal rotation of the elastic member along the cam member.

3. The switching device of claim 2, wherein the elastic member and the cam member are configured to provide a predetermined torque to the drive unit for maintaining the first interrupter unit in an open state.

4. The switching device of claim 3, wherein the predetermined torque is a function of a time delay required to be maintained between movement of the first interrupter unit from the closed state to the open state and movement of the second interrupter unit from the open state to the closed state.

5. The switching device of claim 4, wherein the switching device is a medium voltage switchgear having an operational rating of up to approximately 38 kilo Volts and up to approximately 40 kilo Amperes.

6. The switching device of claim 1, wherein the elastic member and the cam member are configured to provide a predetermined torque to the drive unit for maintaining the first interrupter unit in an open state.

7. The switching device of claim 6, wherein the predetermined torque is a function of a time delay required to be maintained between movement of the first interrupter unit from the closed state to the open state and movement of the second interrupter unit from the open state to the closed state.

8. The switching device of claim 1, wherein the lever member is configured to pivot about a point for enabling movement of the first interrupter unit and the second interrupter unit between the closed state and the open state.

9. The switching device of claim 1, wherein the kinematic linkage arrangement is configured to assume a first position and a second position, such that when in the first position the first interrupter unit is in the closed state and the second interrupter unit is in the open state, and when in the second position, the first interrupter unit is in the open state and the second interrupter unit is in the closed state.

10. The switching device of claim 1, wherein the switching device is a medium voltage switchgear having an operational rating of up to approximately 38 kilo Volts and up to approximately 40 kilo Amperes.

11. The switching device of claim 1, wherein the switching device is a medium voltage switchgear having an operational rating of up to approximately 38 kilo Volts and up to approximately 40 kilo Amperes.

* * * * *